US010364636B2

(12) United States Patent
Davis et al.

(10) Patent No.: US 10,364,636 B2
(45) Date of Patent: Jul. 30, 2019

(54) SWELLABLE CASING ANCHOR

(71) Applicant: TAM INTERNATIONAL, INC., Houston, TX (US)

(72) Inventors: Tim Davis, Spring, TX (US); Art Loginov, Houston, TX (US); Ray Frisby, Houston, TX (US)

(73) Assignee: TAM INTERNATIONAL, INC., Houston, TX (US)

( * ) Notice: Subject to any disclaimer, the term of this patent is extended or adjusted under 35 U.S.C. 154(b) by 526 days.

(21) Appl. No.: 14/337,902

(22) Filed: Jul. 22, 2014

(65) Prior Publication Data

US 2015/0021049 A1 Jan. 22, 2015

Related U.S. Application Data

(60) Provisional application No. 61/857,086, filed on Jul. 22, 2013, provisional application No. 61/942,960, filed on Feb. 21, 2014.

(51) Int. Cl.
*E21B 33/12* (2006.01)
*E21B 23/01* (2006.01)

(52) U.S. Cl.
CPC ..... *E21B 33/1208* (2013.01); *E21B 23/01* (2013.01)

(58) Field of Classification Search
CPC ..... E21B 33/1208; E21B 33/1277
USPC ..... 166/122
See application file for complete search history.

(56) References Cited

U.S. PATENT DOCUMENTS 2,420,226 A * 5/1947 Claus ..... E21B 33/1277 166/187
3,385,367 A 5/1968 Kollsman
4,871,179 A * 10/1989 Bell ..... E21B 33/1277 166/187
7,721,799 B2 * 5/2010 Baski ..... E21B 34/10 166/101
7,762,322 B2 7/2010 Andersen et al.
7,819,200 B2 10/2010 Cornelissen
7,931,092 B2 4/2011 Olinger
7,997,338 B2 * 8/2011 Foster ..... E21B 33/1208 166/188
8,083,000 B2 12/2011 Nutley et al.
8,087,459 B2 1/2012 Caldwell et al.
(Continued)

FOREIGN PATENT DOCUMENTS

EP 2184437 A2 5/2010
WO WO 2013/191687 A1 * 6/2012

OTHER PUBLICATIONS

Definition of "groove" accessed on Mar. 3, 2017 via www.thefreedictionary.com/groove.*
(Continued)

*Primary Examiner* — Giovanna C Wright
*Assistant Examiner* — Manuel C Portocarrero
(74) *Attorney, Agent, or Firm* — Adolph Locklar

(57) ABSTRACT

A method for anchoring a casing string within a wellbore is disclosed. The method includes providing a casing string, where the casing string being generally tubular, and coupling a swellable elastomeric material on at least a portion of the exterior of the casing string. In addition, the method includes positioning the casing string within a wellbore, exposing the swellable elastomeric material to a swelling fluid, and sealing the swellable elastomeric material to the wellbore.

27 Claims, 6 Drawing Sheets

(56) References Cited

U.S. PATENT DOCUMENTS

| | | | | |
|---|---|---|---|---|
| 8,397,803 | B2 | 3/2013 | Crabb et al. | |
| 8,434,570 | B2 * | 5/2013 | Boulet | E21B 7/04 175/320 |
| 8,555,961 | B2 | 10/2013 | Koloy et al. | |
| 9,708,880 | B2 * | 7/2017 | Solhaug | E21B 33/128 |
| 2007/0158060 | A1 * | 7/2007 | Baaijens | E21B 17/1035 166/65.1 |
| 2008/0078561 | A1 * | 4/2008 | Chalker | E21B 33/1208 166/387 |
| 2008/0093086 | A1 | 4/2008 | Courville et al. | |
| 2009/0200043 | A1 | 8/2009 | Olinger | |
| 2009/0211770 | A1 | 8/2009 | Nutley et al. | |
| 2010/0051294 | A1 | 3/2010 | Nutley et al. | |
| 2010/0147508 | A1 | 6/2010 | Foster | |
| 2010/0307737 | A1 * | 12/2010 | Mellemstrand | F16L 55/132 166/118 |
| 2011/0290472 | A1 | 12/2011 | Doweidt et al. | |
| 2012/0000676 | A1 | 1/2012 | Mebratu | |
| 2012/0006530 | A1 | 1/2012 | Crabb et al. | |
| 2012/0012343 | A1 | 1/2012 | Wilkin et al. | |
| 2012/0018143 | A1 | 1/2012 | Lembcke | |
| 2012/0024544 | A1 | 2/2012 | Hepburn | |
| 2012/0031608 | A1 | 2/2012 | Lembcke et al. | |
| 2012/0055667 | A1 | 3/2012 | Ingram et al. | |
| 2012/0168160 | A1 | 7/2012 | Nutley et al. | |
| 2014/0318812 | A1 | 10/2014 | Moyes | |
| 2015/0021044 | A1 | 1/2015 | Davis et al. | |
| 2015/0021049 | A1 | 1/2015 | Davis et al. | |
| 2016/0010422 | A1 | 1/2016 | Goodman | |
| 2016/0024859 | A1 | 1/2016 | Farmer et al. | |
| 2016/0130907 | A1 | 5/2016 | Lundgard | |

OTHER PUBLICATIONS

Definition of "stepped" accessed on Mar. 3, 2017 via www.thefreedictionary.com/stepped.*

Definition of "coiled" accessed on Mar. 3, 2017 via www.thefreedictionary.com/coiled.*

Definition of "slipped" accessed on Mar. 3, 2017 via www.thefreedictionary.com/slipped.*

International Search Report and Written Opinion issued in International Application No. PCT/US2014/047626, dated Nov. 12, 2014 (11 pages).

International Search Report and Written Opinion issued in International Application No. PCT/US2014/047623, dated Nov. 12, 2014 (11 pages).

Extended European Search Report issued in European Patent No. 14829833.4, dated Feb. 16, 2017 (10 pages).

* cited by examiner

SWELLABLE CASING ANCHOR

CROSS-REFERENCE TO RELATED APPLICATIONS

This application is a non-provisional application which claims priority from U.S. provisional application No. 61/857,086, filed Jul. 22, 2013. This application also claims priority from U.S. provisional application No. 61/942,960, filed Feb. 21, 2014.

TECHNICAL FIELD/FIELD OF THE DISCLOSURE

The present disclosure relates generally to tubulars for use in a wellbore, and specifically to the anchoring of tubulars within a wellbore.

BACKGROUND OF THE DISCLOSURE

When forming a wellbore, a drilling rig typically begins by drilling a certain distance into the Earth and then positioning a tubular known as a "surface casing" into the wellbore. The surface casing, as understood in the art may, for example, provide a position to which a wellhead may be mounted to the wellbore. In some instances, the wellhead may include a blowout preventer (BOP) positioned to, for example, prevent high pressure fluids from exiting the wellbore if, for example, a high pressure formation is encountered during the drilling operation. Because these pressures may be extremely high, the surface casing to which the BOP is mounted must be securely coupled to the earthen formation. Typically, surface casing is cemented to the wellbore in order to anchor it in place.

SUMMARY

The present disclosure provides for a method for anchoring a casing string within a wellbore. The method may include providing a casing string, the casing string being generally tubular. The method may also include coupling a swellable elastomeric material on at least a portion of the exterior of the casing string, positioning the casing string within a wellbore, exposing the swellable elastomeric material to a swelling fluid, and sealing the swellable elastomeric material to the wellbore.

The present disclosure also provides for a method for anchoring a casing string within a wellbore. The method may include providing a first casing tubular. The first casing tubular may include a first generally tubular mandrel and a first swellable packer element positioned on the outside surface of the first casing tubular. The method may also include coupling the first casing tubular to a casing tubular string, positioning the casing tubular string within a wellbore, exposing the first swellable packer element to a swelling fluid, and sealing the first swellable packer element to the wellbore.

The present disclosure also provides for a casing string for use in a wellbore. The casing string may include a plurality of casing tubulars. The plurality of casing tubulars may be coupled end to end to form the casing string. The casing string may also include a swellable elastomeric material coupled to the exterior of at least a portion of the plurality of casing tubulars. The swellable elastomeric material may be formed by a plurality of swellable packer elements. The swellable elastomeric material may be positioned to expand when exposed to a swelling fluid. The swellable elastomeric material may be adapted to, when expanded, contact the wellbore and exert a normal force thereagainst. The normal force may provide a frictional force between the swellable elastomeric material and the wellbore sufficient to resist movement of the casing string within the wellbore caused by fluid pressure within the wellbore.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
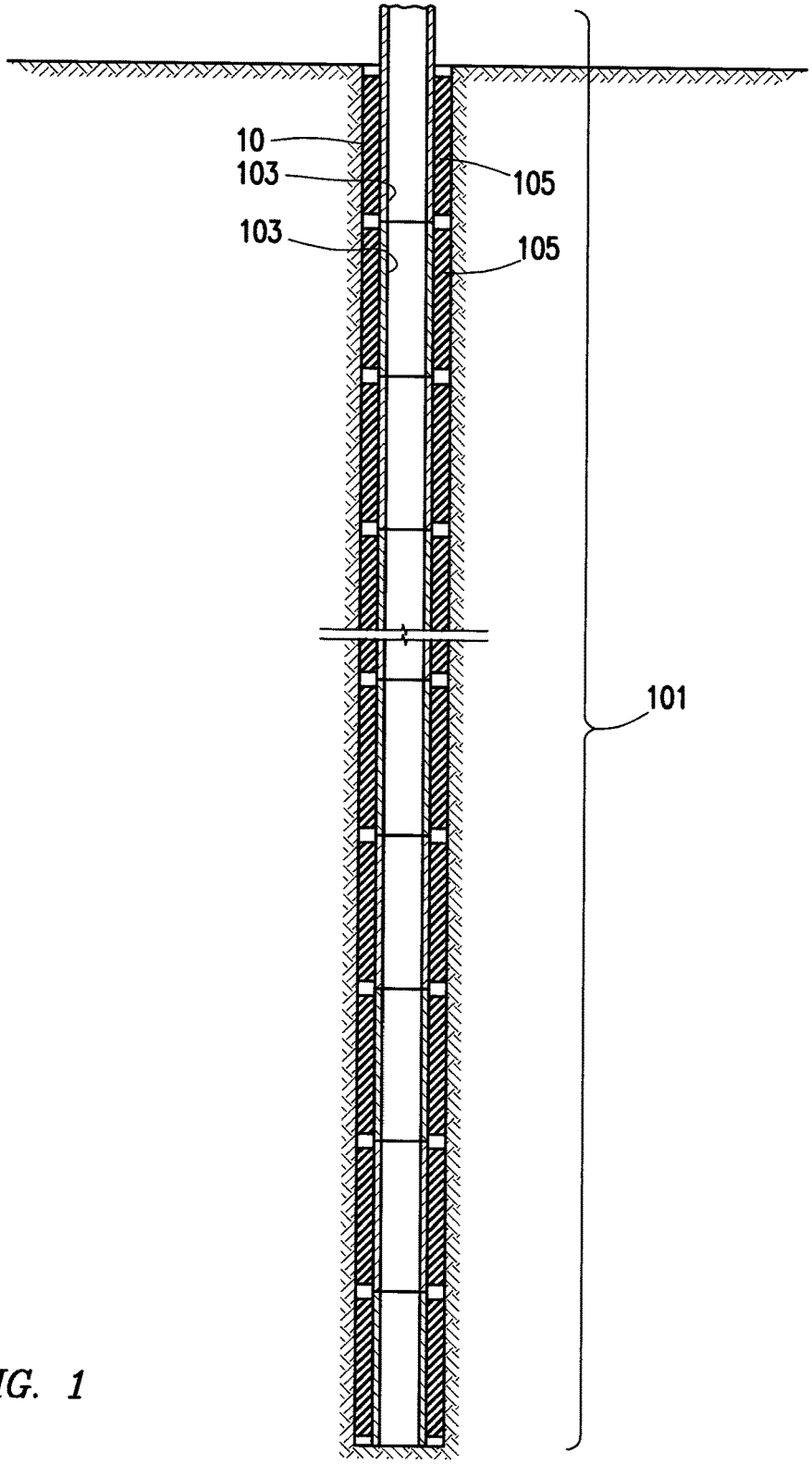
FIG. 1 is a cross-section view of a casing string consistent with embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

In some embodiments of the present disclosure, a length of surface casing 101 is positioned within a wellbore 10 as depicted in FIG. 1. Surface casing 101 may be made up of a plurality of casing tubulars 103 each joined end-to-end to make up surface casing 101. Swellable packer elements 105 may be positioned on the outer surface of some or all of casing tubulars 103. Swellable packer elements 105 are positioned between the outer surface of casing tubulars 103 and the surrounding wellbore 10. Swellable packer elements 105 have an outer diameter and thickness such that the outer diameter of swellable packer elements 105 is less than the diameter of wellbore 10, allowing casing tubulars 103 to be positioned within wellbore 10.

Swellable packer elements 105 are formed from a swellable elastomeric material which increases in volume in response to the absorption of a swelling fluid, generally an oil or water-based fluid. The composition of the swelling fluid needed to activate swellable packer elements 105 may be selected with consideration of the conditions of the wellbore. For example, where surface casing 101 is to be positioned in a subsea wellbore, swellable packer elements 105 may be constructed of a material which swells in response to water may be used to, for example, allow seawater naturally flowing within the wellbore to actuate swellable packer elements 105.

Once surface casing 101 is activated, the swelling fluid may come into contact with swellable packer elements 105 and may be absorbed by the elastomeric material. In response to the absorption of swelling fluid, swellable packer elements 105 increase in volume and may contact wellbore 10. Continued swelling of swellable packer elements 105 may form a seal between casing tubulars 103 and wellbore 10. The fluid seal may serve to, for example and without limitation, prevent any high-pressure fluids which may be encountered during the life of the wellbore from escaping around surface casing 101.

Additionally, the normal force exerted between casing tubulars 103 and wellbore 10 by the expanded swellable packer elements 105 may serve to anchor casing tubulars 103 in place within wellbore 10 by creating friction between swellable packer elements 105 and wellbore 10. Because wellbore 10 may be irregularly shaped, the ability of swellable packer elements 105 to conform to the inner surface of wellbore 10 may allow not only a tight seal therebetween, but may also increase the contact area between swellable packer elements 105 and wellbore 10. By utilizing multiple swellable packer elements 105 positioned on multiple casing tubulars 103 to make up surface casing 101, the contact area between swellable packer elements 105 and wellbore 10 may be further increased. The cumulative frictional force created across surface casing 101 may thus allow surface casing 101 to remain anchored to wellbore 10 in the event of a high-pressure event during the life of the wellbore. In the case that a BOP is attached to the top of surface casing 101, surface casing 101 may thus adequately resist being forced out of wellbore 10 as a result of any high-pressure fluids whose escape is prevented by the BOP.

Figure 2:
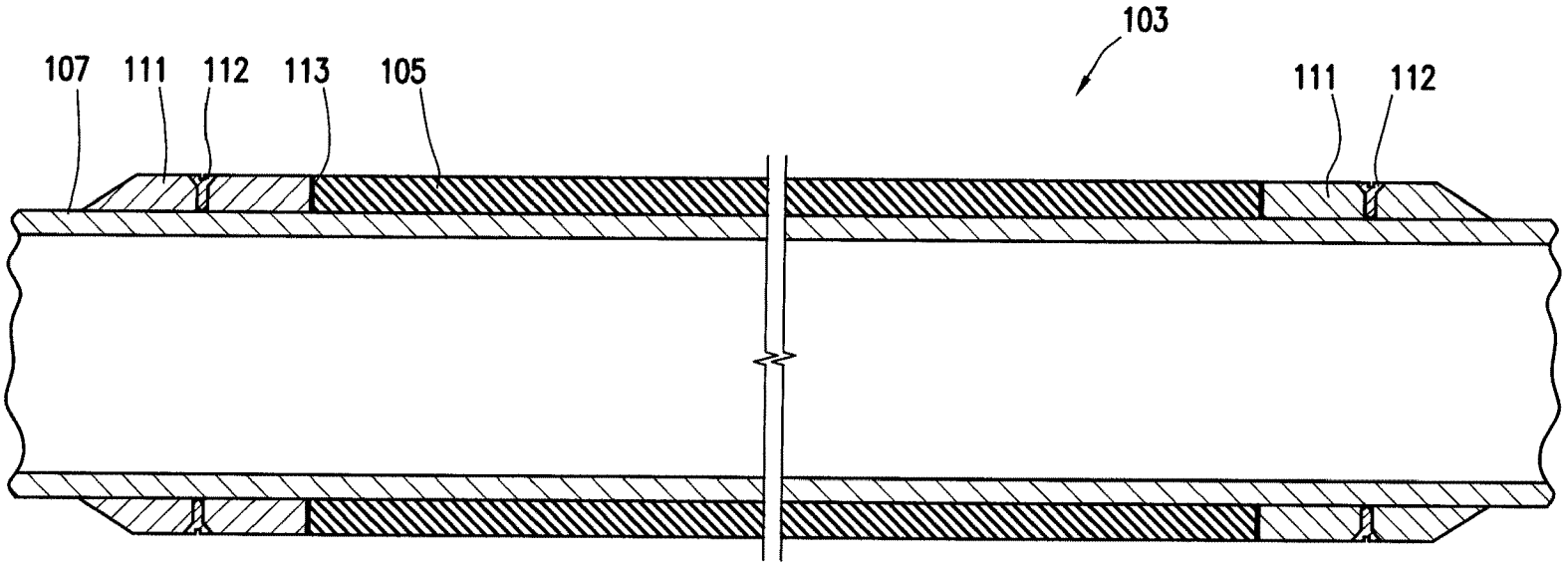
FIG. 2 is a partial cross-section of a casing tubular consistent with at least one embodiment of the present disclosure.

In some embodiments, as depicted in FIG. 2, casing tubular 103 may include mandrel 107. In some embodiments, the exterior surface of mandrel 107 may be generally cylindrical. Swellable packer element 105 is positioned over the exterior surface of mandrel 107. In some embodiments, swellable packer element 105 may be fixed to the outer diameter of mandrel 107 and formed by wrapped layers. In other embodiments, swellable packer element 105 may be molded directly onto the outer diameter of mandrel 107. In some embodiments, as depicted in FIG. 2, swellable packer element 105 may be slipped over mandrel 107 and held in place at either end by end caps 111. End caps 111 may be held against mandrel 107 by any acceptable method, including, for example, adhesive, mechanical bonding, as a split ring using a tightening screw, as two or more clamped sections which bolt to each other, or, as depicted in FIG. 2, as two or more clamped sections attached directly to mandrel 107 by screws 112. In some embodiments, a seal 113 may be inserted between end caps 111 and swellable packer element 105. In some embodiments, swellable packer element 105 may be held in place with the use of a rigid end ring.

Figure 3:
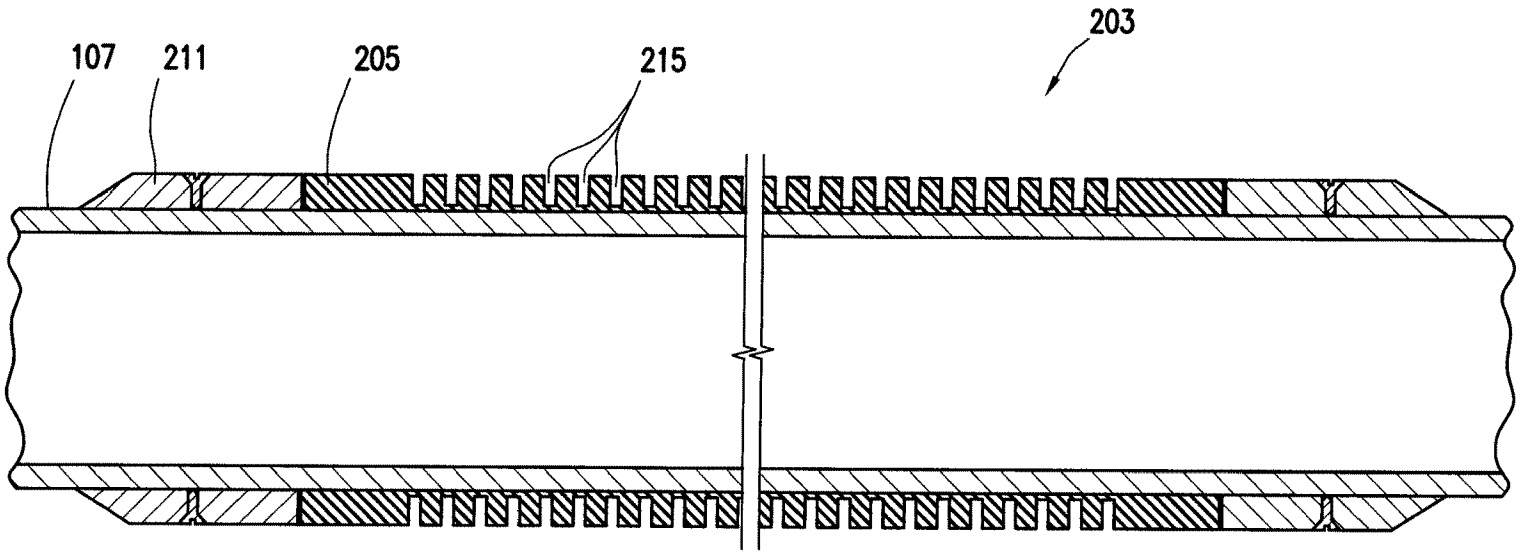
FIG. 3 is a partial cross-section of a casing tubular consistent with at least one embodiment of the present disclosure.
Figure 4:
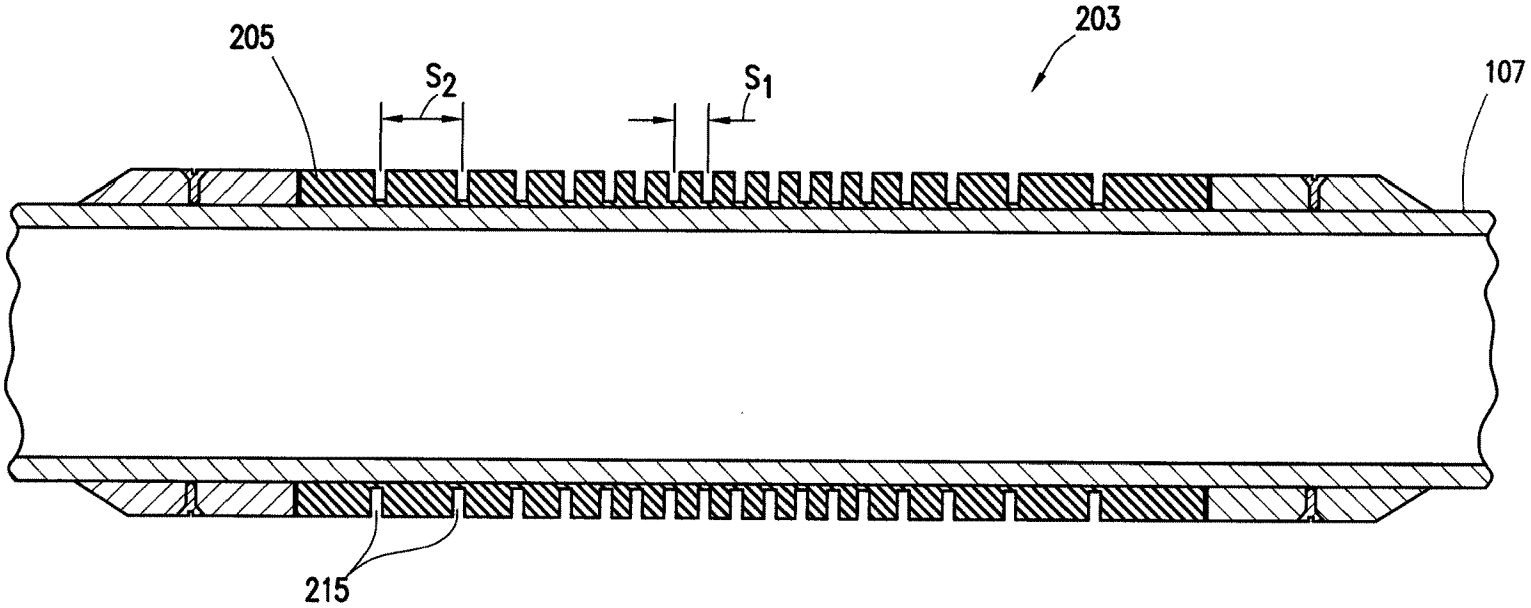
FIG. 4 is a partial cross-section of a casing tubular consistent with at least one embodiment of the present disclosure.

In some embodiments, as depicted in FIG. 3, swellable packer element 205 may further include a plurality of grooves 215. Grooves 215 may be formed in the outer surface of swellable packer element 205. Grooves 215 may, for example, increase the surface area of swellable packer element 205 exposed to the swelling fluid, thus allowing for a more rapid increase in volume of swellable packer element 205. Grooves 215 may be arranged circumferentially, longitudinally along swellable packer element 205, or in a helical pattern. Grooves 215 may, as depicted in FIG. 3, be equally spaced longitudinally (or radially for longitudinal grooves) or, as depicted in FIG. 4, the space between adjacent grooves 215 may vary. For example, as depicted in FIG. 4, grooves 215 towards the middle of swellable packer element 205 may have a closer spacing ($s_1$) than the spacing ($s_2$) of grooves 215 toward the extremities of swellable packer element 205 to, for example, allow swellable packer element 205 to more uniformly increase in volume.

Grooves 215 may be formed in the outer surface of swellable packer element 205 by any suitable process including, without limitation, injection molding, material removal (e.g. turning on a lathe, milling, melting away, etc.), laminating, wrapping, compressing, or other methods recognizable by those of ordinary skill in the art with the benefit of this disclosure. In some embodiments, swellable packer element 205 may be made up of two or more portions of swellable elastomer.

Figure 5:
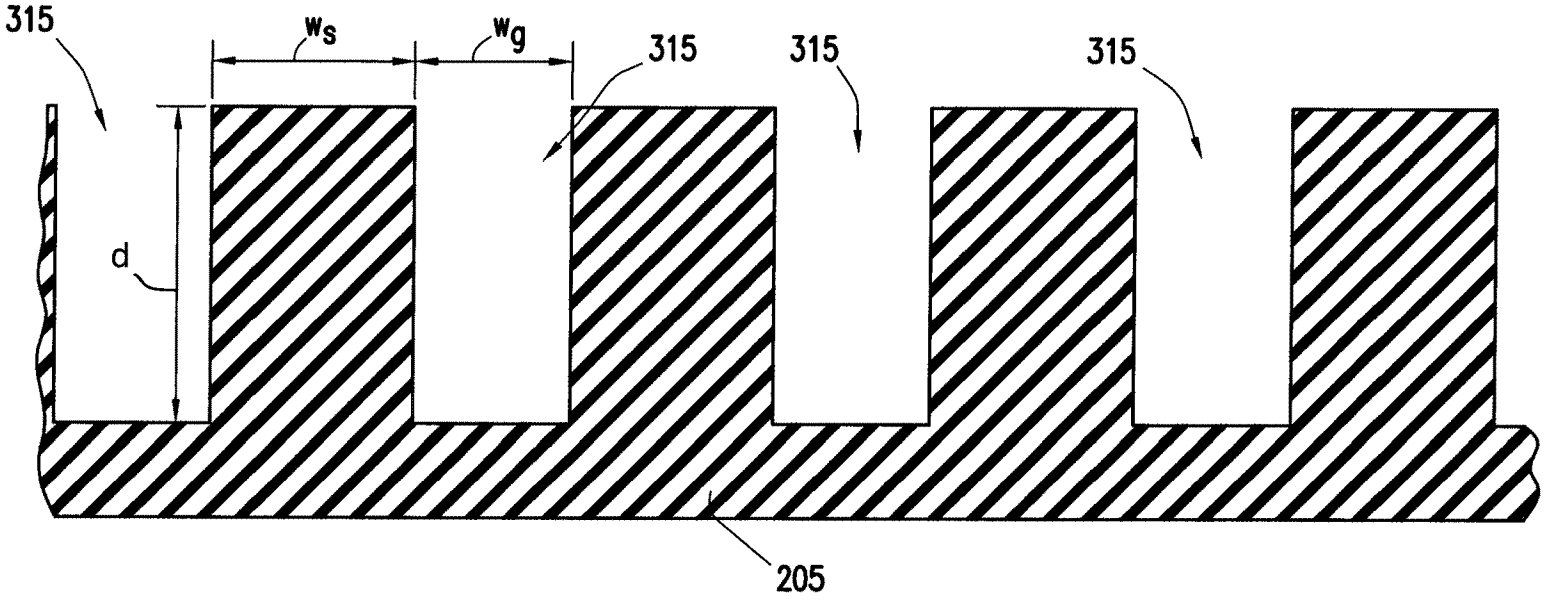
FIG. 5 is a partial cross-section of a swellable packer element exhibiting grooves that are each consistent with at least one embodiment of the present disclosure.
Figure 6:
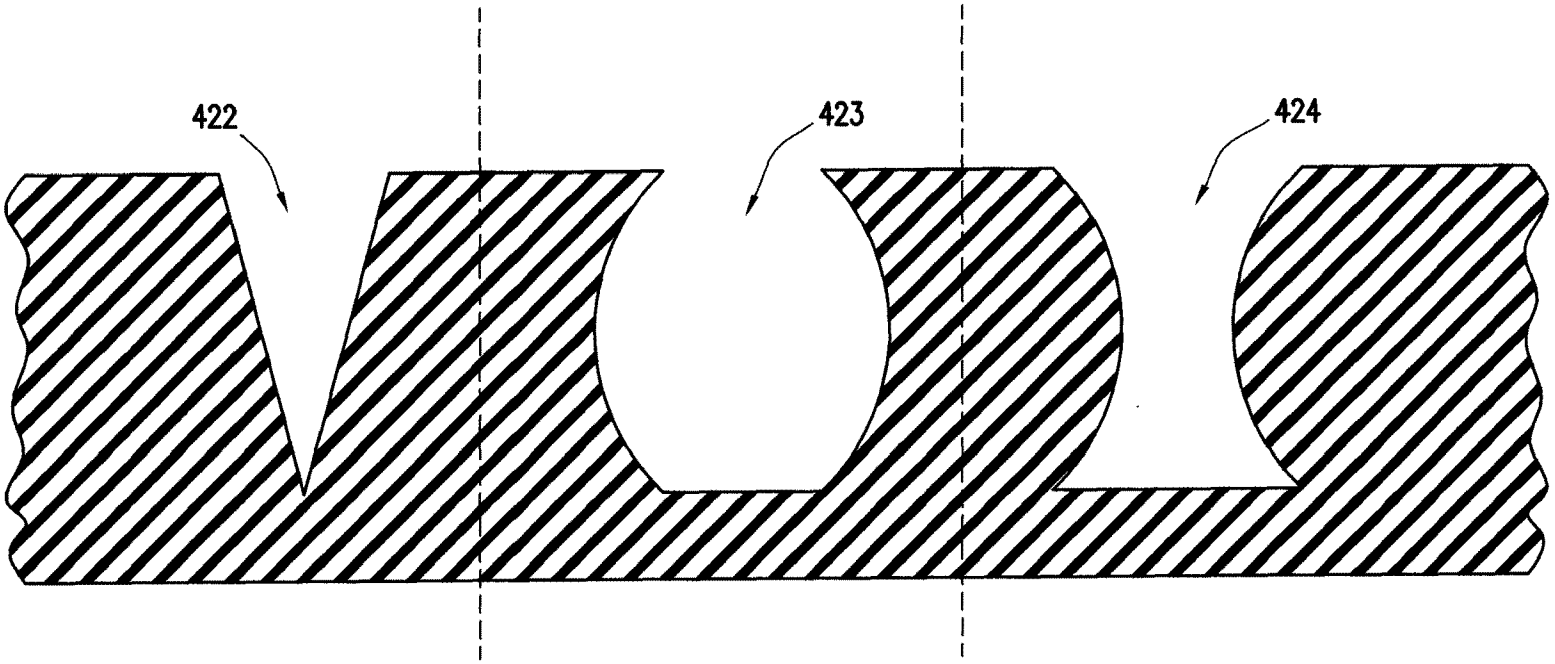
FIG. 6 is a cross section of a swellable packer element that is consistent with at least one embodiment of the present disclosure.

Additionally, grooves 215 may be of varying cross-sectional geometry. For example, FIG. 5 shows a series of grooves 315 having rectangular cross sections. Each groove 315 has a depth d and a groove width $w_g$. Grooves 315 are spaced apart by spacing width $w_s$. Furthermore, as shown by FIG. 6, grooves 215 may have non-rectangular cross-sections. For example, grooves 215 may be triangular 422, have concave walls 423, or have convex walls 424. One of ordinary skill in the art with the benefit of this disclosure will understand that specifications such as the number of grooves, depth d, groove width $w_g$, spacing width $w_s$, and cross-sectional shape may be varied to, for example, change the behavior of swellable packer element 205 depending on certain design parameters, including but not limited to material properties of swellable packer element 205; length, diameter, and thickness of swellable packer element 205; the rate at which swellable packer element 205 is designed to expand; and the method used to form grooves 215. One of ordinary skill in the art will also understand that one or more of these specifications may be varied within the same swellable packer element 205 such that grooves 215 in one section of swellable packer element 205 are different from those in a different section of swellable packer element 205.

For example, the selection of groove width $w_g$ may directly impact the efficacy of the swellable packer element 205 in making a seal. Too wide of a groove width $w_g$ may result in inadequate sealing towards the middle of the groove. Rather than forming a relatively continuous seal between mandrel 107 and the wellbore or surrounding tubular, the base of the groove 215 may not fully contact the wellbore or surrounding tubular when fully swelled. Alternatively, too narrow of a groove width $w_g$ may not appreciably aid in sealing over a comparable swellable packer having no grooves. The ratio between groove width $w_g$ and spacing width $w_s$ along with the number of grooves 215 per length of swellable elastomeric body 10 may be selected in light of these considerations.

In the present disclosure, the number of grooves 215 may be from 5-500, from 25-100, or from 40-75. Spacing widths $w_s$ between grooves 215 may be between 0.5 and 4 inches, alternatively between 0.75 and 2 inches, or alternatively about 1 inch. The widths $w_g$ of grooves 215 may be between 0.05 inches to 1 inch, alternatively between 0.1 to 0.6 inches, or alternatively between about 0.15 to about 0.25 inches.

Depths d of grooves 215 depend in part on the thickness of swellable packer element 205. As will be appreciated by those of ordinary skill in the art with the benefit of this disclosure, the rate at which swellable packer element 205 expands will depend in part on the depth d of grooves 215, but will also appreciate that the depth d of grooves 215 will also affect the integrity of swellable packer element 205. Typically, grooves 215 will not be so deep as to reach mandrel 107. In certain embodiments of the present disclosure, the groove penetrates between 1 and 95% of the thickness of swellable packer element 205, between 1 and 50% of the thickness of swellable packer element 205, or between 5 and 30% of the thickness of swellable packer element 205.

In some embodiments, as nonlimiting examples, the distance between an end cap 211 and the first groove of grooves 215 may range from 1 inch to 1 foot, from 3 inches to 9 inches or between 4 and 7 inches.

The total length of surface casing 101 may, in some embodiments be up to several thousands of feet in length. In some embodiments, the entirety of surface casing 101 is surrounded by swellable packer elements 105. In other embodiments, only certain portions of surface casing 101 include swellable packer elements 105. In some embodiments, swellable packer elements may utilize different groove patterns depending on, for example and without limitation, the position within wellbore 10 into which the corresponding casing tubular 103 is to be placed.

As an example of the use of a surface casing 101 as described herein, an exemplary drilling operation will now be described. To begin drilling a wellbore 10, a drilling rig drills a first section of wellbore. Typically referred to as "spudding" a well, this initial operation may proceed from several hundred to several thousand feet into the Earth. The drill string, typically including a spudding bit, is removed from wellbore 10. Surface casing 101 is then lowered into wellbore 10. As previously discussed, surface casing 101 may be made up of a series of casing tubulars 103, at least a portion of which include swellable packer elements 105 on their outer surface. Each such casing tubular 103 is attached to the top of the last casing tubular 103 previously lowered into the well by the drilling rig. Thus, surface casing 101 grows in length as it is lowered into wellbore 10. Once surface casing 101 has reached the desired length and/or depth, swellable packer elements 105 are exposed to the swelling fluid and increase in volume. In some examples, such as in undersea wells where water is used as the swelling fluid, the swelling process begins immediately. In other examples, a swelling fluid, be it water or oil-based, may be introduced into wellbore 10 to cause swellable packer elements 105 to expand. As swellable packer elements 105 expand and contact wellbore 10, a secure, permanent anchoring may be achieved. At this point, drilling operations may commence as normal without having to cement surface casing 101 in place.

In some embodiments, only some of casing tubulars 103 of surface casing 101 include swellable packer elements 105. In some embodiments, a higher density—density defined as the number of swellable packer elements 105 divided by the number of casing tubulars 103 for a given length of surface casing 101—of swellable packer elements 105 may be positioned to either or both the top and bottom ends of surface casing 101. As swelling fluid only enters wellbore 10 from the top or bottom of the spudded wellbore in some instances, any swellable packer elements 105 positioned towards the middle of surface casing 101 may, for example, not receive enough swelling fluid to fully swell if all swellable packer elements 105 were forced to share the same amount of swelling fluid from wellbore 10. Thus, by reducing the density of swellable packer element 105 toward the middle while maintaining high swellable packer element density toward the ends of surface casing 101, a larger contact area may be formed between swellable packer elements 105 and wellbore 10. One having ordinary skill in the art with the benefit of this disclosure will understand that the density of swellable packer elements 105 may be varied along the length of surface casing 101 and swellable packer elements 105 may be distributed in any way along surface casing 101 without deviating from the scope of this disclosure.

In some embodiments, the number, pattern, size, shape, and orientation as previously discussed of grooves 215 positioned on swellable packer elements 105 may be varied depending on the position within wellbore 10 that the individual casing tubular 103 is to be placed. For example, in an embodiment in which swelling fluid is only supplied from the top of wellbore 10, such as in a subsea well, a larger number of grooves 215 may be formed in swellable packer elements 105 for casing tubulars 103 positioned deeper within wellbore 10 than those near the surface of wellbore 10. Thus, the increased surface area, as previously discussed, of swellable packer elements 105 found deeper in wellbore 10 may allow these swellable packer elements 105 to fully expand before swellable packer elements 105 located closer to the surface of wellbore 10 block the supply of swelling fluid. In some embodiments, grooves 215 on swellable packer elements 105 positioned closer to the surface of wellbore 10 may be positioned longitudinally along swellable packer elements 105, while grooves 215 on swellable packer elements 105 positioned deeper in wellbore 10 may be radially positioned. In such an embodiment, the longitudinal grooves 215 may allow swelling fluid to flow past the swellable packer elements closer to the surface of wellbore 10 for a longer period of time as these swellable packer elements 105 begin to swell, while allowing the deeper swellable packer elements to more quickly swell from the radial arrangement of grooves 215.

In some embodiments, the chemical makeup of swellable packer elements 105 may vary depending on the position within wellbore 10 that the individual casing tubular 103 is to be placed. For example, in an embodiment in which swelling fluid is only supplied from the top of wellbore 10, such as in a subsea well, a swellable packer element 105 having more rapid expansion rate may be positioned deeper within wellbore 10 than a swellable packer element 105 having a slower expansion rate. In such an embodiment, the slower expansion of swellable packer elements 105 near the surface of wellbore 10 may allow swellable fluid to reach the deeper swellable packer elements 105 for a longer period of time, while allowing the deeper swellable packer elements 105 to fully expand.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method for anchoring a casing string within a wellbore, the method comprising:

providing the casing string, the casing string being generally tubular, the casing string having a central axis and an exterior surface, the casing string being made up of a plurality of casing tubulars;

coupling a swellable elastomeric material on at least a portion of the exterior surface of the casing string; the swellable elastomeric material formed as individual swellable packer elements positioned on at least some of the casing tubulars coupled to the swellable elastomeric material, each swellable packer element coupled to the outer surface of a casing tubular, each casing tubular having a swellable packer element coupled thereto defining a swellable casing tubular, and each casing tubular not having a swellable packer element coupled thereto defining a bare casing tubular, wherein at least one swellable packer element includes a plurality of grooves formed in an outer surface of the swellable packer element, the plurality of grooves arranged longitudinally along the swellable packer element and parallel to the central axis;

positioning the casing string within a wellbore such that a density of swellable casing tubulars is higher at an end of the casing string than the density of swellable casing tubulars at the middle of the casing string or the density of swellable casing tubulars is higher at the middle of the casing string than the density of swellable casing tubulars at the end of the casing string;

exposing the swellable elastomeric material to a swelling fluid; and sealing the swellable elastomeric material to the wellbore.

2. The method of claim 1, wherein each casing tubular of the plurality of casing tubulars is a swellable casing tubular.

3. The method of claim 1, wherein the swellable elastomeric material exerts sufficient force on the wellbore such that the casing string, by friction between the swellable elastomeric material and the wellbore, resists motion within the wellbore.

4. The method of claim 3, wherein the friction is sufficient to resist a predetermined force applied to the casing string caused by fluid pressure within the wellbore.

5. The method of claim 4, wherein the casing string is not cemented to the wellbore.

6. A method for anchoring a casing string within a wellbore, the method comprising:

providing the casing string, the casing string being generally tubular, the casing string having a central axis and an exterior surface, the casing string being made up of a plurality of casing tubulars;

coupling a swellable elastomeric material on at least a portion of the exterior surface of the casing string; the swellable elastomeric material formed as individual swellable packer elements positioned on at least some of the casing tubulars coupled to the swellable elastomeric material, each swellable packer element coupled to the outer surface of a casing tubular, each casing tubular having a swellable packer element coupled thereto defining a swellable casing tubular, and each casing tubular not having a swellable packer element coupled thereto defining a bare casing tubular, wherein at least one swellable packer element includes a plurality of grooves formed in an outer surface of the swellable packer element, the plurality of grooves arranged longitudinally along the swellable packer element and parallel to the central axis wherein the number of grooves on a first swellable packer element of a first swellable casing tubular is larger than the number of grooves on a second swellable packer element of a second swellable casing tubular or the cross section, size, orientation, or pattern of grooves on the first swellable packer element of the first swellable casing tubular is different than that of grooves of the second swellable packer element of the second swellable casing tubular;

positioning the casing string within a wellbore;

exposing the swellable elastomeric material to a swelling fluid; and sealing the swellable elastomeric material to the wellbore.

7. The method of claim 6, wherein the first swellable casing tubular is positioned on the casing string closer to the surface of the wellbore than the second swellable casing tubular.

8. A method for anchoring a casing string within a wellbore, the method comprising:

providing the casing string, the casing string being generally tubular, the casing string having a central axis and an exterior surface, the casing string being made up of a plurality of casing tubulars;

coupling a swellable elastomeric material on at least a portion of the exterior surface of the casing string; the swellable elastomeric material formed as individual swellable packer elements positioned on at least some of the casing tubulars coupled to the swellable elastomeric material, each swellable packer element coupled to the outer surface of a casing tubular, each casing tubular having a swellable packer element coupled thereto defining a swellable casing tubular, and each casing tubular not having a swellable packer element coupled thereto defining a bare casing tubular, wherein the swellable elastomeric material of a first swellable packer element of a first swellable casing tubular swells more rapidly than the swellable elastomeric material of a second swellable packer element of a second swellable casing tubular, wherein at least one swellable packer element includes a plurality of grooves formed in an outer surface of the swellable packer element, the plurality of grooves arranged longitudinally along the swellable packer element and parallel to the central axis;

positioning the casing string within a wellbore;

exposing the swellable elastomeric material to a swelling fluid; and sealing the swellable elastomeric material to the wellbore.

9. A method for anchoring a casing string within a wellbore, the method comprising:

providing a first casing tubular, the first casing tubular including a first generally tubular mandrel having a central axis and a first swellable packer element positioned on the outside surface of the first casing tubular, the first swellable packer element having a plurality of grooves formed in an outer surface of the first swellable packer element, the plurality of grooves arranged longitudinally along the first swellable packer element and parallel to the central axis, wherein the distance between adjacent grooves in a first location along the first swellable packer element is different from the distance between adjacent grooves in a second location along the swellable elastomeric body;

coupling the first casing tubular to a casing tubular string;

positioning the casing tubular string within the wellbore;

exposing the first swellable packer element to a swelling fluid; and sealing the first swellable packer element to the wellbore.

10. The method of claim 9, further comprising:

providing a second casing tubular, the second casing tubular including a second generally tubular mandrel and a second swellable packer element positioned on the outside surface of the second casing tubular;

coupling the second casing tubular to the first casing tubular;

exposing the second swellable packer element to the swelling fluid; and sealing the second swellable packer element to the wellbore.

11. The method of claim 10, wherein the second swellable packer element comprises a second plurality of grooves, the second plurality of grooves arranged longitudinally along the second swellable packer element.

12. The method of claim 10, wherein the second swellable packer element comprises a second plurality of grooves, the second plurality of grooves arranged circumferentially about the second swellable packer element.

13. A method for anchoring a casing string within a wellbore, the method comprising:

providing a first casing tubular, the first casing tubular including a first generally tubular mandrel having a central axis and a first swellable packer element positioned on the outside surface of the first casing tubular, the first swellable packer element having a plurality of grooves formed in an outer surface of the first swellable packer element, the plurality of grooves arranged longitudinally along the first swellable packer element and parallel to the central axis;

coupling the first casing tubular to a casing tubular string;

providing a second casing tubular, the second casing tubular including a second generally tubular mandrel and a second swellable packer element positioned on the outside surface of the second casing tubular, the second swellable packer element including a second plurality of grooves, the second plurality of grooves arranged in a helical pattern about the second swellable packer element;

coupling the second casing tubular to the first casing tubular;

positioning the casing tubular string within the wellbore;

exposing the first swellable packer element and the second swellable packer element to a swelling fluid; and sealing the first swellable packer element and the second swellable packer element to the wellbore.

14. The method of claim 13, further comprising:

providing a third casing tubular, the third casing tubular including a third generally tubular mandrel; and coupling the third casing tubular to the first casing tubular.

15. The method of claim 13, wherein the swelling fluid is water based.

16. The method of claim 13, wherein the swelling fluid is oil based.

17. The method of claim 13, wherein the distance between each groove of the plurality of grooves is between 0.5 and 4 inches.

18. The method of claim 13, wherein the width of each groove of the plurality of grooves is between 0.05 inches and 1 inch.

19. The method of claim 13, wherein the depth of each groove of the plurality of grooves is between 1% and 50% of the thickness of the generally tubular elastomeric sleeve.

20. The method of claim 13, wherein the first swellable packer element is formed by wrapped layers.

21. The method of claim 13, wherein the first swellable packer element is slipped over the mandrel and held in place by the ends of the first swellable packer element.

22. The method of claim 21, wherein the ends are held against the mandrel.

23. The method of claim 13, wherein at least one groove of the plurality of grooves has a rectangular cross-section.

24. The method of claim 13, wherein at least one groove of the plurality of grooves has a triangular cross-section.

25. The method of claim 13, wherein at least one groove of the plurality of grooves further comprises side-walls having a curved profile.

26. A casing string for use in a wellbore, the casing string comprising:

a plurality of casing tubulars, the plurality of casing tubulars coupled end to end to form the casing string, the casing string having a central axis; and a swellable elastomeric material coupled to the exterior of at least a portion of the plurality of casing tubulars, the swellable elastomeric material formed by a plurality of swellable packer elements, at least one swellable packer element including a plurality of grooves formed in an outer surface of the swellable packer element, the plurality of grooves arranged longitudinally along the first swellable packer element and parallel to the central axis, the swellable elastomeric material positioned to expand when exposed to a swelling fluid, the swellable elastomeric material adapted to, when expanded, contact the wellbore and exert a normal force thereagainst, the normal force providing a frictional force between the swellable elastomeric material and the wellbore sufficient to resist movement of the casing string within the wellbore caused by fluid pressure within the wellbore, a density of swellable casing tubulars being higher at an end of the casing string than the density of swellable casing tubulars at the middle of the casing string or the density of swellable casing tubulars being higher at the middle of the casing string than the density of swellable casing tubulars at the end of the casing string.

27. The casing string of claim 26, wherein the frictional force is sufficient to resist movement of the casing string within the wellbore so that the casing string remains in the wellbore without being cemented thereto.

* * * * *